United States Patent [19]

Maeshima

[11] 4,149,272

[45] Apr. 17, 1979

[54] MULTIPURPOSE VEST

[75] Inventor: Seiichi Maeshima, Higashiosaka, Japan

[73] Assignee: Descente Co., Ltd., Osaka, Japan

[21] Appl. No.: 857,323

[22] Filed: Dec. 5, 1977

[30] Foreign Application Priority Data

Jun. 20, 1977 [JP] Japan ..... 52-117589

[51] Int. Cl.[2] ..... A41D 1/04

[52] U.S. Cl. ..... 2/102

[58] Field of Search ..... 2/102, 95, 93, 91, 87, 2/83, 85, 108, 247, 513, 574

[56] References Cited

U.S. PATENT DOCUMENTS

| | | | |
|---|---|---|---|
| 186,917 | 1/1877 | Reed | 128/574 |
| 2,359,012 | 9/1944 | Sophier | 2/247 |
| 2,368,654 | 2/1945 | Frank | 2/94 |
| 2,448,416 | 8/1948 | Carter | 2/94 |
| 2,492,862 | 12/1949 | Harvey | 2/247 |
| 2,919,443 | 1/1960 | Kashiyama | 2/108 |
| 3,085,250 | 4/1963 | Finlay | 2/102 |
| 3,670,340 | 6/1972 | Walker | 2/93 |

*Primary Examiner*—Werner H. Schroeder
*Assistant Examiner*—Doris Troutman
*Attorney, Agent, or Firm*—Frank J. Jordan

[57] ABSTRACT

A multipurpose vest suitable particularly for skiers' use, comprising quilted front and back bodices, the back bodice being provided with an opening for a pocket for holding therein clothing, such as a waterproofed jacket, wearable under the vest after withdrawn from the pocket whenever necessary.

3 Claims, 4 Drawing Figures

MULTIPURPOSE VEST

This invention relates to a novel multipurpose vest suitable particularly for skiers' use and more particularly it relates to a novel multipurpose ski vest such that it may easily be worn by the intending wearer in different manners depending on its use and weather conditions to obtain the optimum protection on the body of the wearer while enjoying its attractive design.

Wearers of a conventional vest have no measures taken for particularly protecting their body with the vest from the chill, rain, snow and the like they may encounter suddenly or unexpectedly in desolate areas such as remote fields and mountains.

This invention has for its object to provide such multipurpose vests as to enable the intending wearers to protect their body from the chill, rain, snow and the like trouble even when they encounter these troubles suddenly or unexpectedly.

The multipurpose vest of the present invention comprises front and back bodices quilted longitudinally thereof except the lower portion of the back bodice, the front bodice being provided with a center-front opening closable by means of a front slide-fastener, the back bodice being designed preferably to have its lower edge curved downward with the center thereof being the lowest thereby rendering the lower portion of the back bodice broad sufficiently to provide therein at waist level an opening for a pocket for holding therein clothing such as a thin waterproofed jacket in folded form, and the opening for the pocket extending laterally of the back bodice and being closable by means of a back slide-fastener. The lower edge of the back bodice may not be one so curved downwardly but may be a straight one if the resulting pocket is not required to be large-sized.

The vests of this invention may preferably be made of Nylon, polyester or cotton fabrics as well as of non-woven cloth, waterproofed paper, synthetic leather or plastic paper. The warmth-keeping materials to be quilted in the vests include synthetic wool made of polyester, Nylon or acrylic fibers and further include feathers and sponge.

This invention will be explained in more detail by reference to the accompanying drawing in which.

Figure 1:
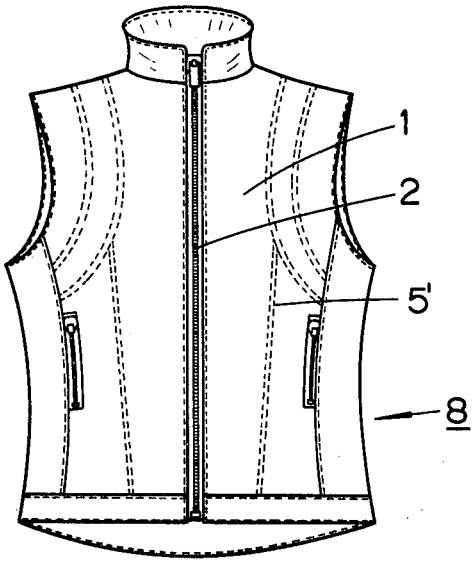
FIG. 1 is a front view of an example of a vest of this invention.

Referring now to FIGS. 1 to 4, the vest 8 of this invention suitable particularly for skiers' use comprises front and back bodices 1, 3 quilted longitudinally (the quilting being indicated at 5') thereof except the lower portion 4 of the back bodice 3, the front bodice 1 being provided with a center-front opening which is closable by means of a front slide-fastener 2, the back bodice 3 being designed preferably to have its lower edge 5 curved downward with the center 6 thereof being the lowest thereby rendering the lower portion 4 of the back bodice 3 broad sufficiently to provide therein at waist level an opening for a waist pocket 7 for holding a clothe such as a thin waterproofed jacket 9 in folded form, the opening for the waist pocket being closable by means of a back slide-fastener 6' and extending at waist level in the lateral direction of the back bodice 3.

Figure 2:
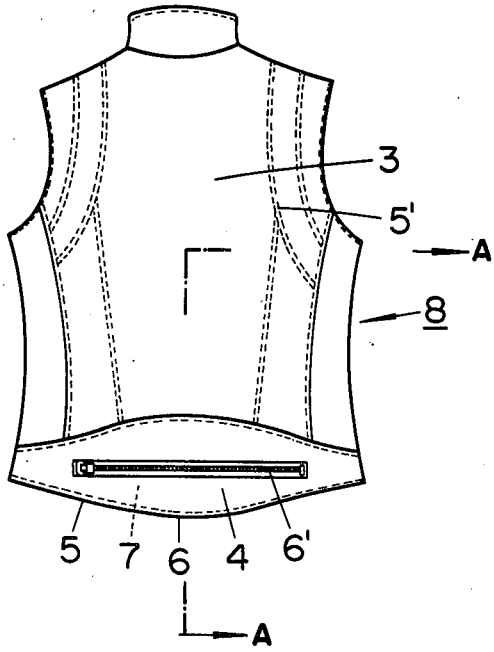
FIG. 2 is a back view of the vest of FIG. 1 having a waist pocket at the lower portion of the back bodice.
Figure 3:
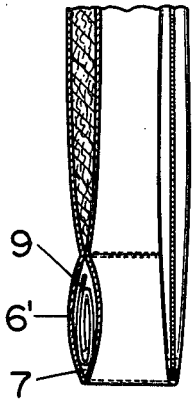
FIG. 3 is a cross-sectional view of the lower portion of the back bodice of FIG. 2 taken along the line A—A.
Figure 4:
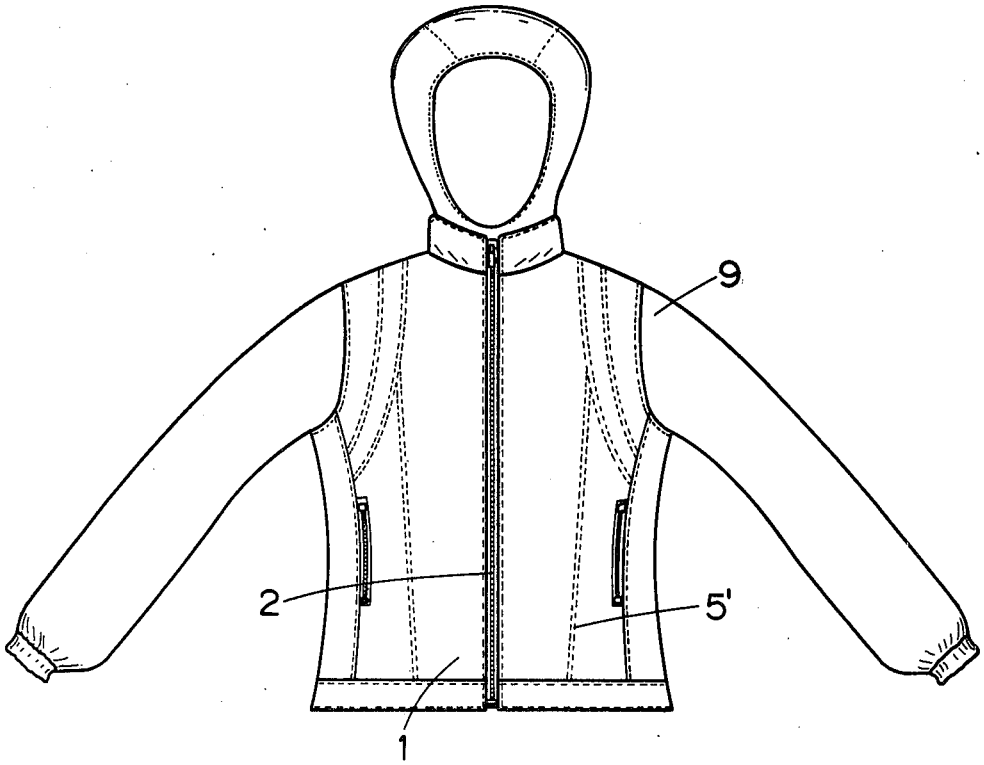
FIG. 4 is a view of a combination of the vest of FIG. 2 and a waterproofed jacket withdrawn from the waist pocket of the vest.

As mentioned above, according to this invention, the back bodice 3 is provided at its lower portion 4 (or at waist level) with the waist pocket 7 in which the jacket 9 can be housed, and, further, the front bodice 1 and back bodice 3 are quilted as indicated at 5' in FIGS. 1, 2 and 4. Therefore, when worn on a ski sweater, the vest 8 comprising the front bodice 1 and the back bodice 3 with the jacket 9 in the waist pocket 7 will enable the wearer to feel comfortable and warm due to the presence of quilting 5', without feeling uncomfortable at the lower portion 4 since the pocket 7 bulged with the jacket 9 matches the quilting 5. Further, when encountered with snowfall or rainfall, the wearer of the vest 8 can easily put off the vest 8, take the jacket 9 out of the waist pocket 7 and put on the jacket 9 over the sweater and then the jacket-free vest over the jacket 9 as shown in FIG. 4, thereby to protect thoroughly the sweater and the like and to protect the wearer from the cold and getting wet. The vest of this invention is also excellently fashionable with advantages in that it allows the wearer to enjoy the easy putting-on and taking-off of the vest 8 in different manners as required (as is exemplified above) by the use of the front slide-fastener 2 of the front bodice 1 in a skiing ground or the like.

As mentioned above, the vest of this invention has great advantages in that it will permit the wearer thereof to easily re-wear it so that the jacket taken out of the waist pocket is worn under the jacket-free vest in combination at any time and place whenever encountered with rainfall or other emergencies, and that it is also suitable as a town wear because it is substantially identical in appearance with usual vests.

I claim:

1. A multipurpose vest comprising a front bodice and a back bodice, said front bodice being quilted, said front bodice having a center front opening, a front slide-fastener for opening and closing said center-front opening, said back bodice having an upper portion and a lower portion, said upper portion being quilted, said lower portion being formed as a pocket, said pocket having a lateral opening extending laterally of the back bodice, a back slide-fastener for opening and closing said lateral opening, a thin waterproof jacket in folded form in said pocket and adapted to be stored in said pocket while the vest is in use and to be readily removed from said pocket and worn with said vest as desired, said pocket being made of non-quilted front and rear panels having their lower edges curved downwardly with the center therof being the lowest, thereby rendering the pocket sufficiently broad to provide at waist level said lateral opening through which said waterproof jacket would be readily removed and reinserted into said pocket, said pocket with said waterproof jacket stored therein expanding the pocket such that the latter forms an extension of the quilted upper portion of the rear bodice.

2. A mulitpurpose vest according to claim 1 wherein said upper and lower portions of said rear bodice are joined by a seam which curves upwardly with the center thereof being the highest, thereby rendering the pocket broader at its center to facilitate removal and insertion of said waterproof jacket through said lateral opening.

3. A multipurpose vest according to claim 2 wherein said pocket with said waterproof jacket stored therein has an overall thickness substantially equal to the overall thickness of the quilted upper rear bodice portion.

* * * * *